United States Patent [19]

Hart

[11] 4,043,113

[45] Aug. 23, 1977

[54] ELECTRIC WATCH BATTERY RETAINER

[75] Inventor: William D. Hart, Santa Ana, Calif.

[73] Assignee: Hughes Aircraft Company, Culver City, Calif.

[21] Appl. No.: 670,292

[22] Filed: Mar. 25, 1976

[51] Int. Cl.[2] ..... G04C 3/00; G04B 19/30

[52] U.S. Cl. ..... 58/23 BA; 58/50 R

[58] Field of Search ..... 58/4 A, 23 BA, 23 R, 58/50 R; 429/98–100

[56] References Cited

U.S. PATENT DOCUMENTS

| | | | |
|---|---|---|---|
| 3,672,153 | 6/1972 | Mutter | 58/23 BA |
| 3,817,021 | 6/1974 | Bergey | 58/85.5 |
| 3,968,640 | 7/1976 | Clemmer et al. | 58/23 BA |
| 3,974,637 | 8/1976 | Bergey et al. | 58/23 R |

*Primary Examiner*—E. S. Jackmon

*Attorney, Agent, or Firm*—Allen A. Dicke, Jr.; W. H. MacAllister

[57] ABSTRACT

Electric watch has its battery held in the battery block in the watch module by means of a retainer spring which resiliently engages the batteries to urge them into proper installed position. Fingers on the spring resiliently engage in the spacer block to provide the spring retaining force. The fingers can be manually disengaged from the back of the spacer block for retainer spring and battery removal.

9 Claims, 4 Drawing Figures

Fig. 1.
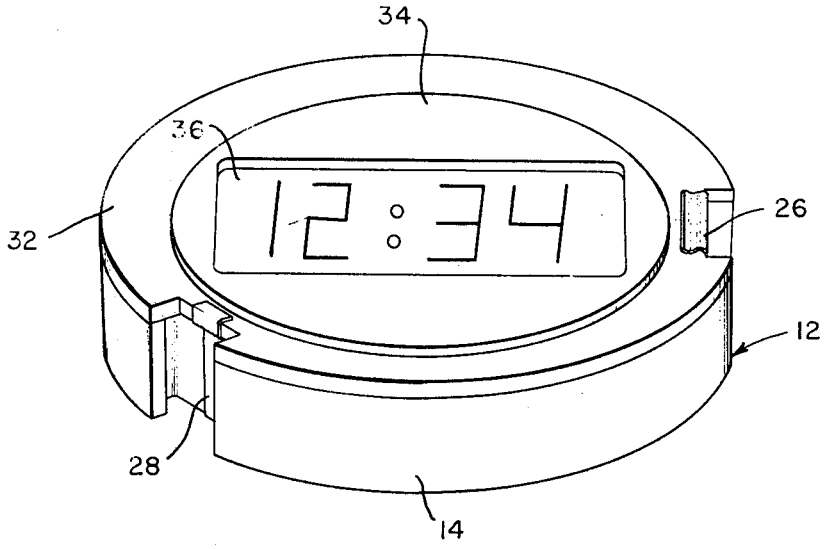
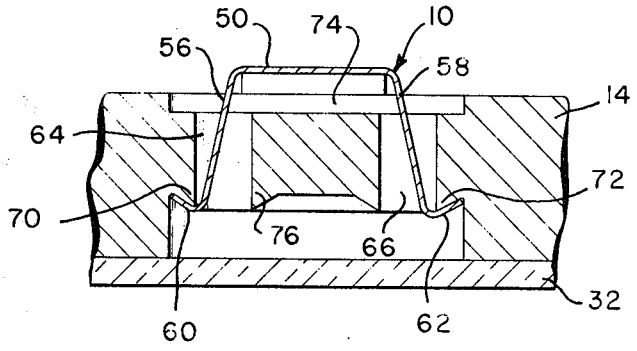
Fig. 4.

ELECTRIC WATCH BATTERY RETAINER

BACKGROUND

This invention is directed to an electric watch module battery retainer where a spring engages the batteries in an electric watch to resiliently restrain them in the watch module so that the module is retained together as an operative unit even outside of the watch case.

In electric watch structures, and paticularly electronic watch structures wherein display of time is digital, as by light emitting diode patterns or liquid crystal display devices, a watch module includes a battery block. Openings therein receive various types of components, including batteries. Often a substrate is mounted against the battery block, with electronic components mounted on the substrate. Usually the display is mounted on the side of the substrate opposite the battery. The substrate and battery block are clamped together so that they form a watch module. An example of this construction is found in R. A. Burke, R. F. Zurcher, and B. Somogyi U.S. Pat. No. 3,983,689. In that disclosure, the structure is clamped together so that a unitary watch module is created with all the operative parts except the batteries assembled together for handlimg, testing, and shipping. Additionally, U.S. Pat. No. 3,996,735 for Electronic Watch Construction by R. F. Zurcher shows another type of module construction wherein the entire module is clamped together at assembly so that a unitary structure results.

Oftentimes the modules are built and not immediately installed into a watch case. This occurs when the modules are assembled, the batteries installed, the watches set and tested, before being passed onto the next department where they are installed in cases. A fixture or storage or shipping container is necessary in such case to hold the batteries in place and make the electrical contact between the batteries to keep the watch running. Sometimes the module manfuacturer ships the operative module in a suitable shipping container, with batteries installed with the module keeping time. When the module is installed in the case, either soon after manufacture or after storage or shipping, it is desirable to transfer the module into the case without breaking the power supply from the battery to the timekeeping electronics, because the breaking of the power supply causes the watch to lose its time memory so that it must be reset. Transfer of the module into the case without breaking the power supply keeps the watch running and elminates the time consuming effort of resetting the watch. Thus, it is desirable to provide a battery retainer for an electric watch module which retains the batteries in electrical connection in the watch and physically retains them in place to unitize the module-battery combination and provide continuity in timekeeping, even when the module is out of the case.

SUMMARY

In order to aid in the understanding of this invention it can be stated in essentially summary form that it is directed to an electric watch battery retainer which comprises a resilient metallic spring which electrically and physically engages on the batteries and resiliently engages in the watch module to maintain electrical contact with the batteries in the module and to hold the batteries in the module.

It is thus an object of this invention to provide a battery retainer for an electric watch which retains the battery in the watch module, so the battery is retained even when the watch module is out of the case. It is another object to provide a battery retainer for an electric watch where the batteries are electrically contacted to provide electrical continuity between the batteries in the module and with the remainder of the electrical circuitry in the module, as well as physically retain the batteries in the module. It is a further object to provide a battery retainer which engages in the module of an electric watch and engages on the batteries in the module, and is removable so that the battery retainer may be removed and replaced for removal and replacement of the batteries. It is another object to provide a battery retainer spring which engages the batteries and retains them in the module, and can also be employed as the battery spring when the module is in a watch case.

Other objects and advantages of this invention will become apparent from a study of the following portion of this specification, the claims and the attached drawings.

BRIEF DESCRIPTION OF THE DRAWINGS

FIG. 1 is an isometric view of an electric watch module which incorporates the battery retainer of this invention.

FIG. 4 is a section through the center of the module, taken generally along the line 4—4 of FIG. 2, with parts broken away, showing the manner in which the battery retainer engages in the battery block.

DESCRIPTION

Figure 2:
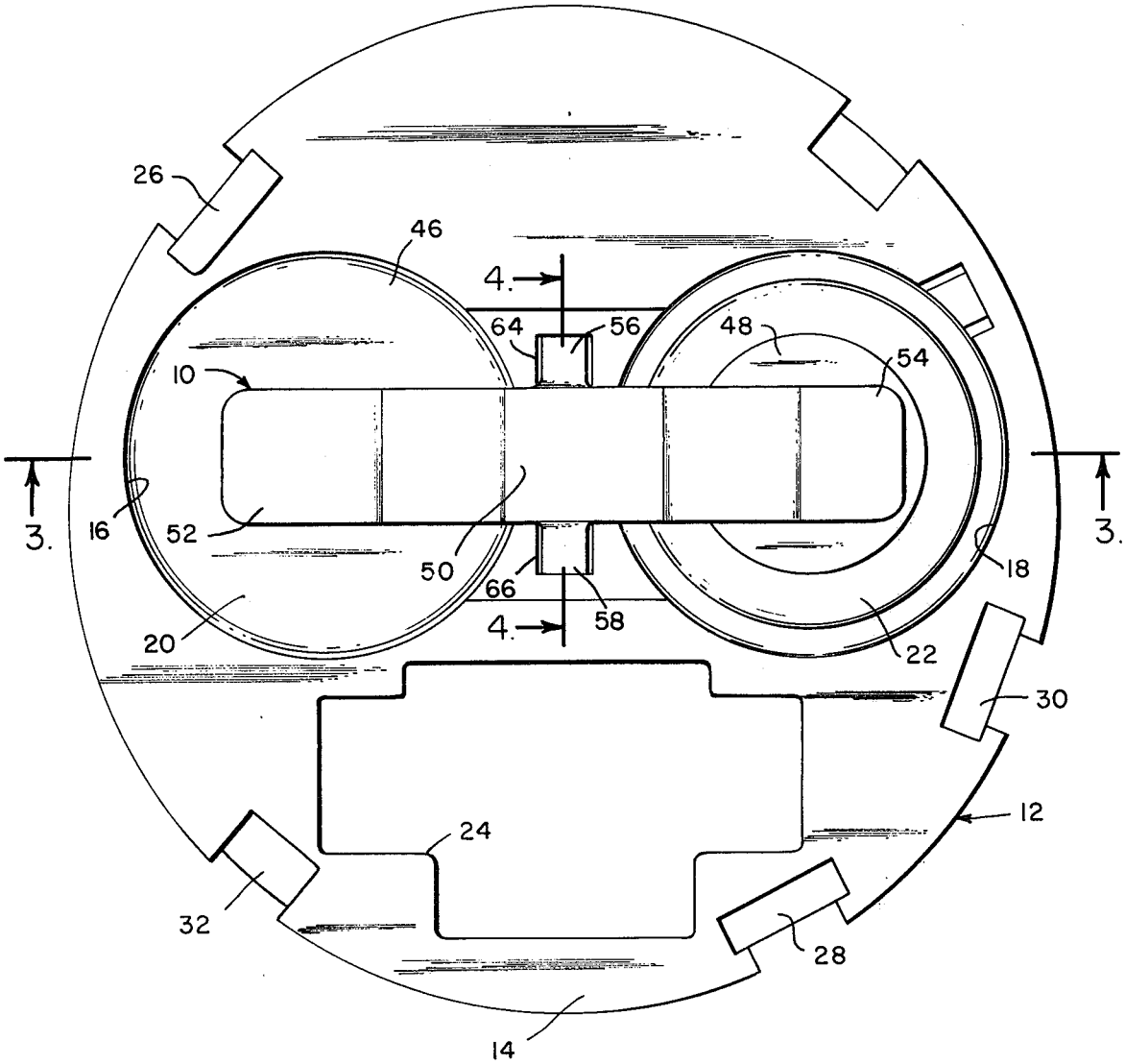
FIG. 2 is a bottom view of the module showing the battery retainer in place.
Figure 3:
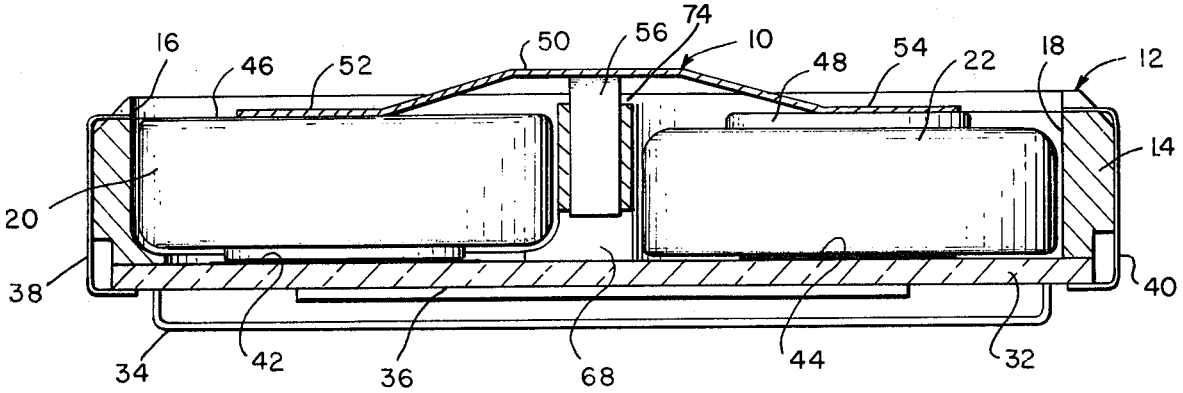
FIG. 3 is a section through the watch module, taken generally along the line 3—3 of FIG. 2.

Battery retainer 10 shown in FIGS. 2, 3, and 4 is part of watch module 12 and acts with the rest of the components of the module to form the module into unitary construction which is complete, including batteries. Watch module 12 comprises battery block 14 which is generally circular or is otherwise shaped to fit within a watch case. Battery block 14 has battery openings 16 and 18 therein which respectively contain batteries 20 and 22. Opening 24 is for one of the larger components of the watch module such as the time reference crystal. Tee slots 26, 28, and 30 are for the reception of J-shaped springs which depend from substrate 32. Such J-shaped springs are for control of the watch electronics by exterior signal such as illustrated in Ho, Belardi, and Reissmueller U.S. Pat. No. 3,846,971. The tee slots position the free legs of the contact springs.

Substrate 32 carries cover plate 34 thereon to protect electronic components mounted on the substrate. These components include digital display devices 36 as well as chips for timekeeping and display energization, printed circuitry and interconnections. As seen in FIG. 1, a window in the cover plate permits viewing of the digital display devices from the front of the watch module. Clamp springs 38 and 40 engage over the top spacer and battery block to clamp them together to make a unitary structure of the module, which can be handled, packaged, and shipped.

Contacts 42 and 44 are formed on the underside of the substrate, that is the side away from the display. These contacts are beneath and in line with battery openings 16 and 18 so that batteries 20 and 22 lie against these contacts when the batteries are installed. When thus installed in a watch case the usual battery contact spring in the back of the watch case contacts the batteries and urges them against the contacts on the substrate. Also they make an electrical connection between the battery contacts 46 and 48 which are away from the substrate. However, in order to retain the batteries in place when there is no case around the module and to make the connection between battery contacts 46 and 48, battery retainer 10 is provided.

Battery retainer 10 is stamped from resilient sheet metal, for example, 0.005 inch thick austenitic stainless steel or equivalent. It is formed into shape to resiliently engage the batteries and the battery block. As seen in FIGS. 2, 3, and 4, battery retainer 10 comprises bridge 50 which has battery contact legs 52 and 54 at the ends. Legs 52 and 54 are in contact with the respective batteries. As is seen in FIG. 3, the contact legs are bent below the plane of the bridge, and in the position shown are already deflected from the free state to provide battery contact pressure. In view of the fact that retainer 10 is metallic, it provides electrical connection between contacts 46 and 48.

To hold battery retainer 10 in place with respect to battery block 14 and the rest of the module, arms 56 and 58 are bent downwardly from bridge 50. Retainer arms 56 and 58 terminate in retainer fingers 60 and 62, see FIG. 4, which extend outwardly for hook engagement with the battery block.

Openings 64 and 66 entend through the battery block to pocket 68 on the substrate side of the battery block. Pocket 68 provides hook walls 70 and 72 on which fingers 60 and 62 engage to hold down battery retainer 10. Thus, when the battery retainer is pressed in place, retainer arms 56 and 58 with their fingers 60 and 62 are squeezed together to enter down through openings 64 and 66 for resilient deflection of legs 52 and 54 until fingers 60 and 62 are engaged. There is sufficient opening to permit the use of tweezers to squeeze arms 56 and 58 together to release the fingers from the hook walls to permit nondestructive removal of battery retainer 10. For those installations in which it is necessary to save space by turning fingers 60 and 62 toward each other instead of away from each other as shown in FIG. 4, alternate hook walls 76 and 78 are also provided.

The completed watch module 12 with its battery retainer allows setting and testing of the watch electronics without breaking the supply of power during storage, shipping, or assembly of the module into a case.

When the module is installed into a case, battery retainer 10 can remain on the module and act against the watch case so that it acts as the battery springs during normal usage. Recess 74, see FIGS. 3 and 4, is provided in the top of battery block 14 so that when the module is installed in a case the case back can push bridge 50 into the recess level with the back of battery block 14. When stressed in that manner fingers 60 and 62 move downward away from walls 70 and 72 into pocket 68 so that now battery retainer 10 thrusts the entire module toward the front of the watch case. Thus battery retainer 10 does not require any additional case thickness for its accommodation. In this way the battery springs in the case can be eliminated. This same action occurs whether or not there are battery springs in the back of the watch case.

The disclosures incorporated herein by reference are hereby in their entirety.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

I claim:

1. An electric watch module, said module being comprised of a battery block having at least one battery opening therein, mounting means adjacent to said battery block for carrying horological electronics and for carrying a display for displaying horological information, the improvement comprising:

first and second hook recesses in said module for engagement with respect to said module; and a battery retaining spring extending over said battery opening in said battery block and having first and second hooks thereon resiliently snapped into and engaged in said hook recesses for releasably resiliently holding a battery in said battery opening in said battery block.

2. The module of claim 1 wherein there are two battery openings in said battery block for respective receipt of two batteries, said battery retaining spring having contact legs for engaging each of the batteries for retaining both of the batteries in their openings.

3. The module of claim 2 wherein said battery retainer spring is metallic so that the batteries in said battery openings are electrically connected through said battery retainer spring.

4. The module of claim 3 wherein the batteries are positionable in said openings in opposite polarity.

5. An electric watch module, said module being comprised of a battery block having two battery openings therein for respective receipt of two batteries, mounting means adjacent to said battery block for containing horological electronics and for carrying a display for displaying horological information, the improvement comprising:

engagement means on said battery block for engagement with respective said battery block;

a metallic battery retaining spring having contact legs for extending over both of the battery openings for engaging each of the batteries for retaining both of the batteries in their openings, said battery retainer spring having a bridge defining a plane and said contact legs being bent away from the plane of said bridge and first and second retainer arms bent down from the plane of said bridge, each of said arms engaging in said engagement means in said battery block.

6. The module of claim 5 wherein there are first and second openings through said battery block and there is a hook wall in association with each of said openings, said retainer arms extending through said openings, said retainer arms having retainer fingers adjacent the end thereof, said retainer fingers engaging said hook walls.

7. An electric watch module, said module being comprised of a battery block having two openings therein for respective receipt of two batteries, mounting means adjacent to said battery block for carrying horological electronics and for carrying a display for displaying horological information, the improvement comprising:

engagement means on said battery block for engagement with respect to said battery block;

a metallic battery retainer spring extending over said battery openings for engaging batteries in the openings for retaining the batteries in the openings and electrically connecting the batteries, a bridge and two retainer arms on said battery retainer spring, said retainer arms being bent away from the plane of said bridge, said retainer arms each terminating in a retainer finger, an opening through said battery block and hook walls adjacent said opening, said fingers engaging said hook walls to retain said battery retainer spring with respect to said battery block.

8. The module of claim 7 wherein a pocket is formed in said battery block at said retainer arm opening on the opposite side fo said battery block from said bridge of said battery retainer spring so that as said bridge is pressed toward said battery block, said retainer fingers move into said pocket.

9. An electric watch module, said module being comprised of a battery block having at least one battery opening therein, mounting means adjacent to said battery block for carrying horological electronics and for carrying a display for displaying horological information, the improvement comprising:

first and second hook walls in said module;

a battery retaining spring engaging over said battery opening in said battery block for engaging with a battery in said battery opening to retain the battery in said battery block, said battery retaining spring having first and second hook fingers thereon, said hook fingers resiliently engaging against said hook walls to resiliently and releasably retain said battery retaining spring with respect to said module.

* * * * *